US005785570A

United States Patent [19]

Bruni

[11] Patent Number: 5,785,570

[45] Date of Patent: Jul. 28, 1998

[54] ANODE FOR A FLAT DISPLAY SCREEN

[75] Inventor: Marie-Dominique Bruni, La Tronche, France

[73] Assignee: Pixtech S.A., Rousset, France

[21] Appl. No.: 619,572

[22] PCT Filed: Jul. 25, 1995

[86] PCT No.: PCT/FR95/00997

§ 371 Date: Jun. 24, 1996

§ 102(e) Date: Jun. 24, 1996

[87] PCT Pub. No.: WO96/03765

PCT Pub. Date: Feb. 8, 1996

[30] Foreign Application Priority Data

Jul. 26, 1994 [FR] France ..... 94 09491

[51] Int. Cl.[6] ..... H01J 9/20; H01J 9/227

[52] U.S. Cl. ..... 445/52; 313/496

[58] Field of Search ..... 445/52, 24; 313/496

[56] References Cited

U.S. PATENT DOCUMENTS

| | | | |
|---|---|---|---|
| 5,577,943 | 11/1996 | Vickers et al. | 445/52 |
| 5,578,902 | 11/1996 | Vickers | 313/496 |
| 5,592,056 | 1/1997 | Peyre et al. | 313/496 |

FOREIGN PATENT DOCUMENTS

| | | | |
|---|---|---|---|
| 349425 | 1/1990 | European Pat. Off. | 313/496 |
| 58-28165 | 2/1983 | Japan | 313/496 |

*Primary Examiner*—Patrick Ryan
*Assistant Examiner*—Jeffrey T. Knapp
*Attorney, Agent, or Firm*—Plevy & Associates

[57] ABSTRACT

A method of fabricating an anode of a flat display screen that includes at least three series of alternated parallel strips of anode conductors is available. For each series of anode conductor strips, there is a single electrically connection pad, each pad being accessible through conductive paths from a same surface level of the anode.

8 Claims, 8 Drawing Sheets

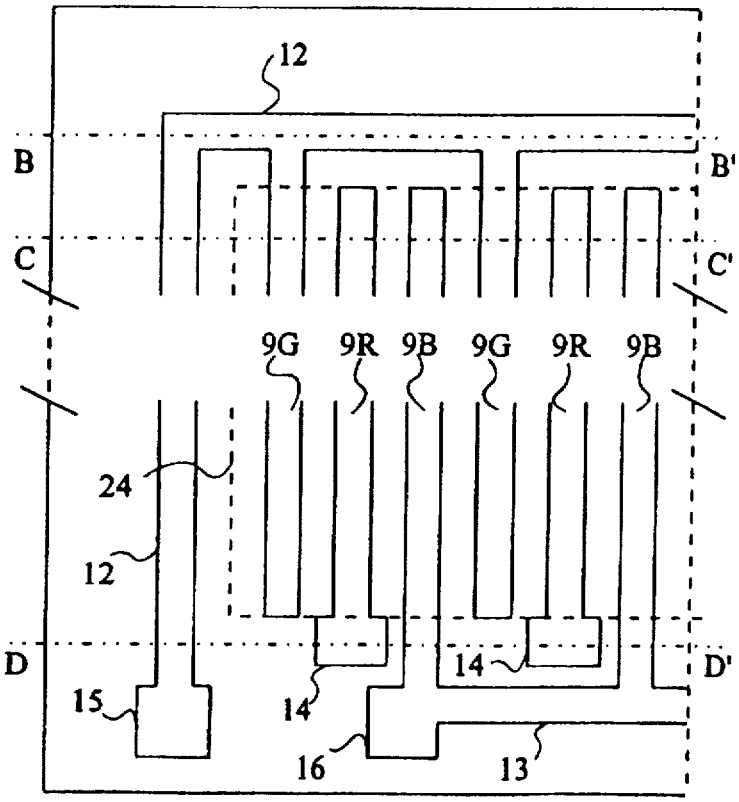
Fig 6A
Fig 6B
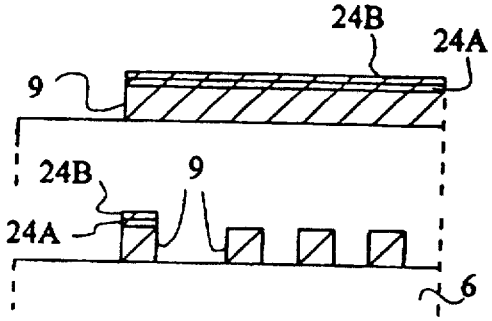
Fig 6C
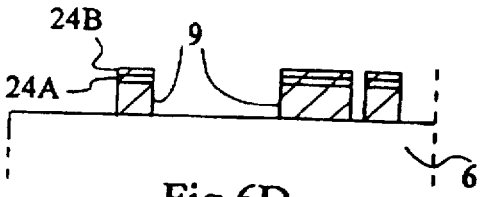
Fig 6D

ANODE FOR A FLAT DISPLAY SCREEN

BACKGROUND OF THE INVENTION

1. Field of the Invention

The present invention relates to anodes for flat display screens. It more particularly relates to the realization of connections of luminescent elements of an anode for color screens such as color screens including microtips.

2. Discussion of the Related Art

FIG. 1 represents the structure of a flat display screen with microtips of the type used according to the invention.

Such microtip screens are mainly constituted by a cathode 1 including microtips 2 and by a gate 3 provided with holes 4 corresponding to the positions of the microtips 2. Cathode 1 is disposed so as to face a cathodoluminescent anode 5, formed on a glass substrate 6 that constitutes the screen surface.

The operation and the detailed structure of such microtip screens are described in U.S. Pat. No. 4,940,916 assigned to Commissariat à l'Energie Atomique.

The cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. The cathode 1 is associated with the gate 3 which is arranged in rows. The intersection of a row of gate 3 with a column of cathode 1 defines a pixel.

This device uses the electric field generated between the cathode 1 and gate 3 so that electrons are transferred from microtips 2 toward phosphor elements 7 of anode 5. The anode 5 is provided with alternate strips of phosphor elements 7, each corresponding to a color (red, green, blue). The strips are separated one from the other by an insulating materiel 8. The phosphor elements 7 are deposited onto electrodes 9, which are constituted by corresponding strips of a transparent conductive layer such as indium and tin oxide (ITO). The groups of red, green, blue strips are alternatively biased with respect to cathode 1 so that the electrons extracted from the microtips 2 of one pixel of the cathode/gate are alternatively directed toward the facing phosphor elements 7 of each color.

The control of the phosphor element 7 (the phosphor element **7*g* in FIG. 1) that should be bombarded by electrons from the microtips 2 of cathode 1 requires to selectively control the biasing of the phosphor elements 7 of anode 5**, for each color.

FIG. 2 schematically illustrates a conventional anode structure. FIG. 2 partially represents a perspective view of an anode 5 fabricated according to known techniques. The interconnection paths 12 and 13 are realized for two (**7*g*, 7*b*) of the three colors of phosphor elements 7. These paths are connected to pads 15, 16, respectively, which are connected, through electrical links 17 and 18, to a control system (not shown). The connection of the phosphor elements 7*r* of the third color is achieved, through a connector 20 including pins 18, on pads 14 disposed at one end of each strip of phosphor elements 7*r* of the corresponding color. The same technique is used for the deposition of phosphor elements 7*g*, 7*b*, 7*r* onto the anode conductor strips with which they are associated. In fact, the phosphor elements 7** are deposited in three successive cataphoresis steps (one for each color). Thus, it must be possible to selectively drive the strips of anode conductors associated with each color.

Using pin connectors requires a plurality of connections, which complicates the structure of the anode and impairs, more particularly, its reliability. In addition, conventional techniques cause a high consumption of expensive metals, especially gold, due to both the anode structure and its fabrication method.

SUMMARY OF THE INVENTION

A specific object of the invention is to avoid the above drawbacks of the prior art techniques by providing an anode for a flat display screen which simplifies the connections between the series of anode conductors and the control system. The invention also aims at simplifying the fabrication of such an anode, and more particularly the deposition of phosphor elements, by enabling to use the same connections either for the anode operation or for deposition of the phosphor elements. A further object of the invention is to provide a fabrication method of such an anode which decreases the consumption of expensive metals.

To achieve these objects, the present invention provides a fabrication method of an anode for a flat display screen, including the following steps:

1) forming, on a substrate, three series of anode conductors in alternated parallel strips, two first interconnection paths of the first two series of anode conductors, first two connection pads to the first two paths, and a third series of anode conductors;
2) depositing an insulating layer and etching, in this insulating layer, holes to receive phosphor elements in register with the anode conductors, and windows in register with the pads;
3) forming a third interconnection path and a third connection pad;
4) depositing phosphor elements over the anode conductors in the holes of the insulating layer.

According to an embodiment of the invention, the first step includes the filling of the windows with a conductive material.

According to another embodiment of the invention, the first steps includes the following steps:

depositing over the whole plate anode conductors on a glass substrate; and etching according to a row pattern, to form the three series of strips of anode conductors in the anode conductor layer, and the first two interconnection paths as well as the pads.

According to another embodiment of the invention, the method further includes the step of depositing a conductive layer over at least two sides of the plate periphery.

According to another embodiment of the invention, the third step further includes the step of depositing a conductive material for filling the windows.

According to another embodiment of the invention, the filling of the windows is achieved by electroless deposition.

According to another embodiment of the invention, the third interconnection path and the third connection pad are achieved by deposition over the whole plate of an organometallic precursor, irradiation of the latter by laser, and removal of the non-irradiated precursor by a suitable solvent.

According to another embodiment of the invention, the fourth step for depositing phosphor elements is achieved by a cataphoretic deposition in three steps, by successively driving the anode conductive strips of the three colors through the connecting pads to which the strips are respectively connected.

The present invention also provides an anode for a flat display screen, including at least three series of alternated parallel strips of anode conductors, including for each series of anode conductor strips a single connection pad, each pad being accessible through conductive paths from a same surface level of the anode.

According to another embodiment of the invention, the anode includes for each series of anode conductor strips, an inter-connection path of the conductor strips, each interconnection path being provided with a pad, all the pads being disposed on a same side of the anode.

The foregoing and other objects, features, aspects and advantages of the invention will become apparent from the following detailed description of the present invention when taken in conjunction with the accompanying drawings.

BRIEF DESCRIPTION OF THE DRAWINGS

FIGS. 4–6D schematically illustrate an embodiment of a first step of the method according to the invention for fabricating the anode of a flat display screen;

DETAILED DESCRIPTION

Figure 1:
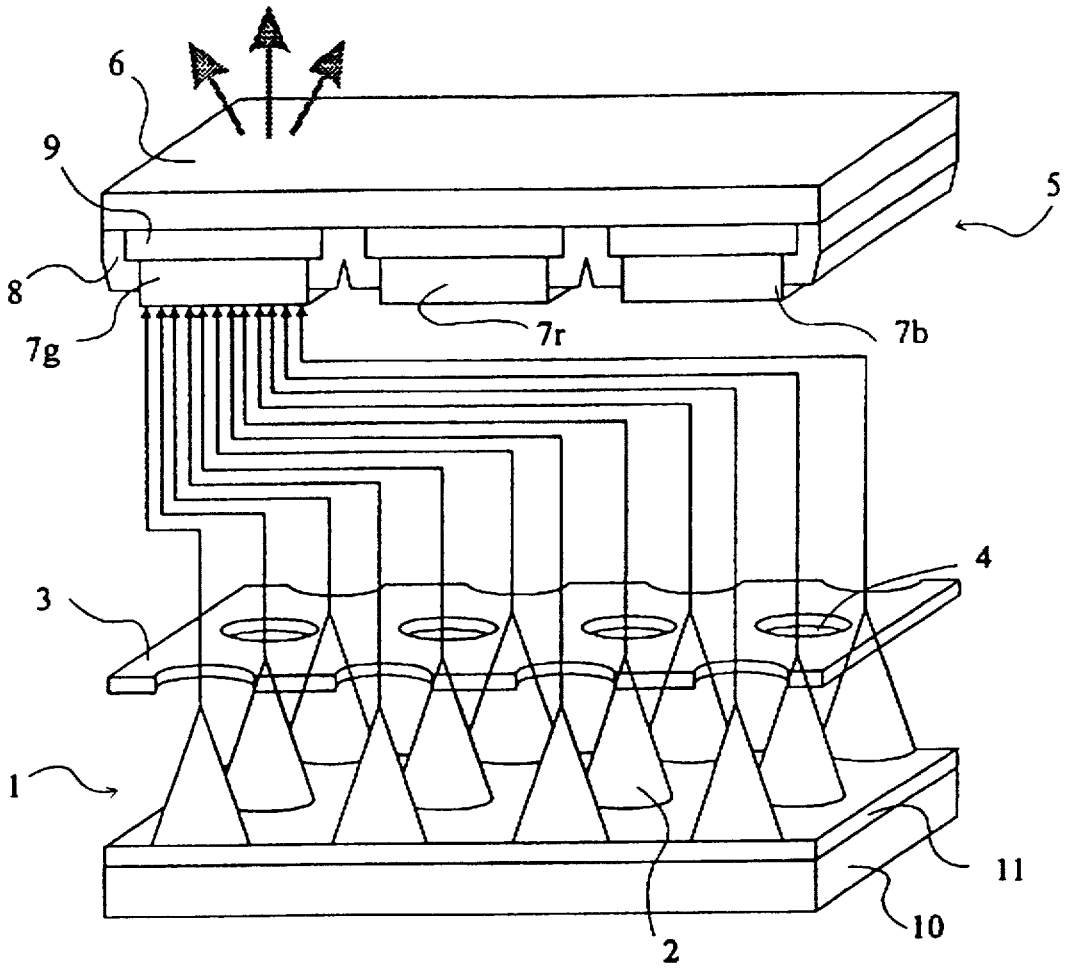
FIGS. 1 and 2, above described, explain the state of the art and the problem encountered.
Figure 2:
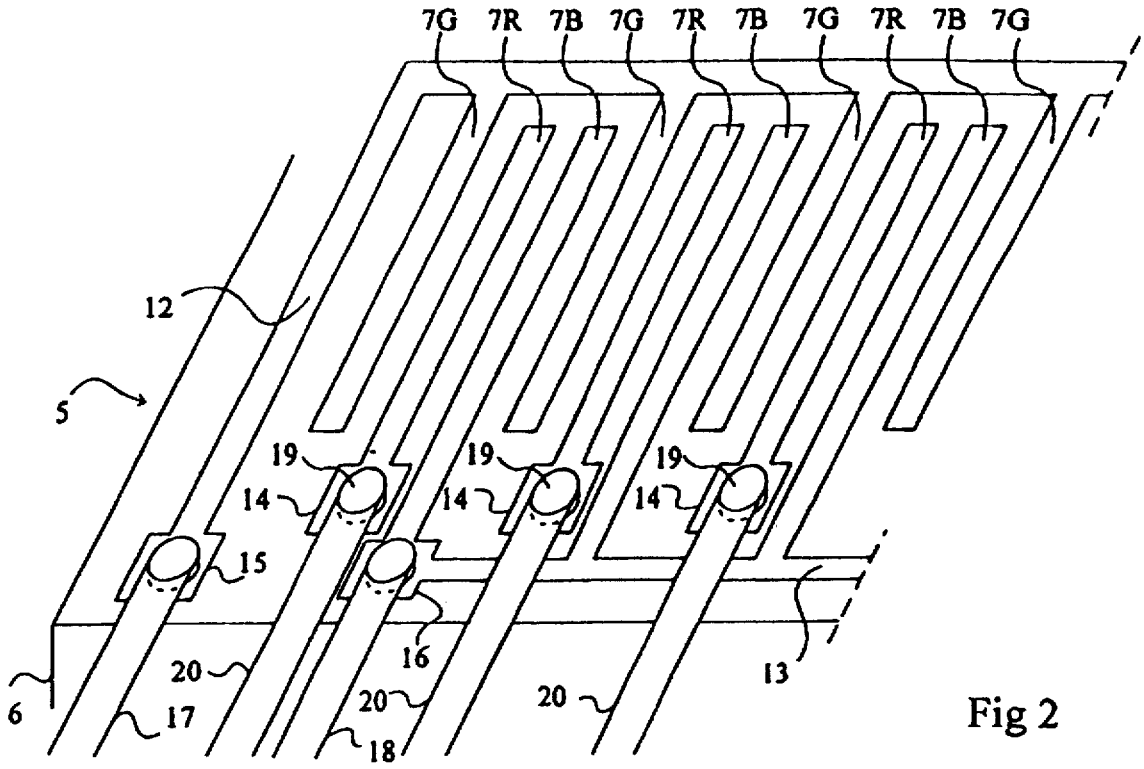
Figure 3:
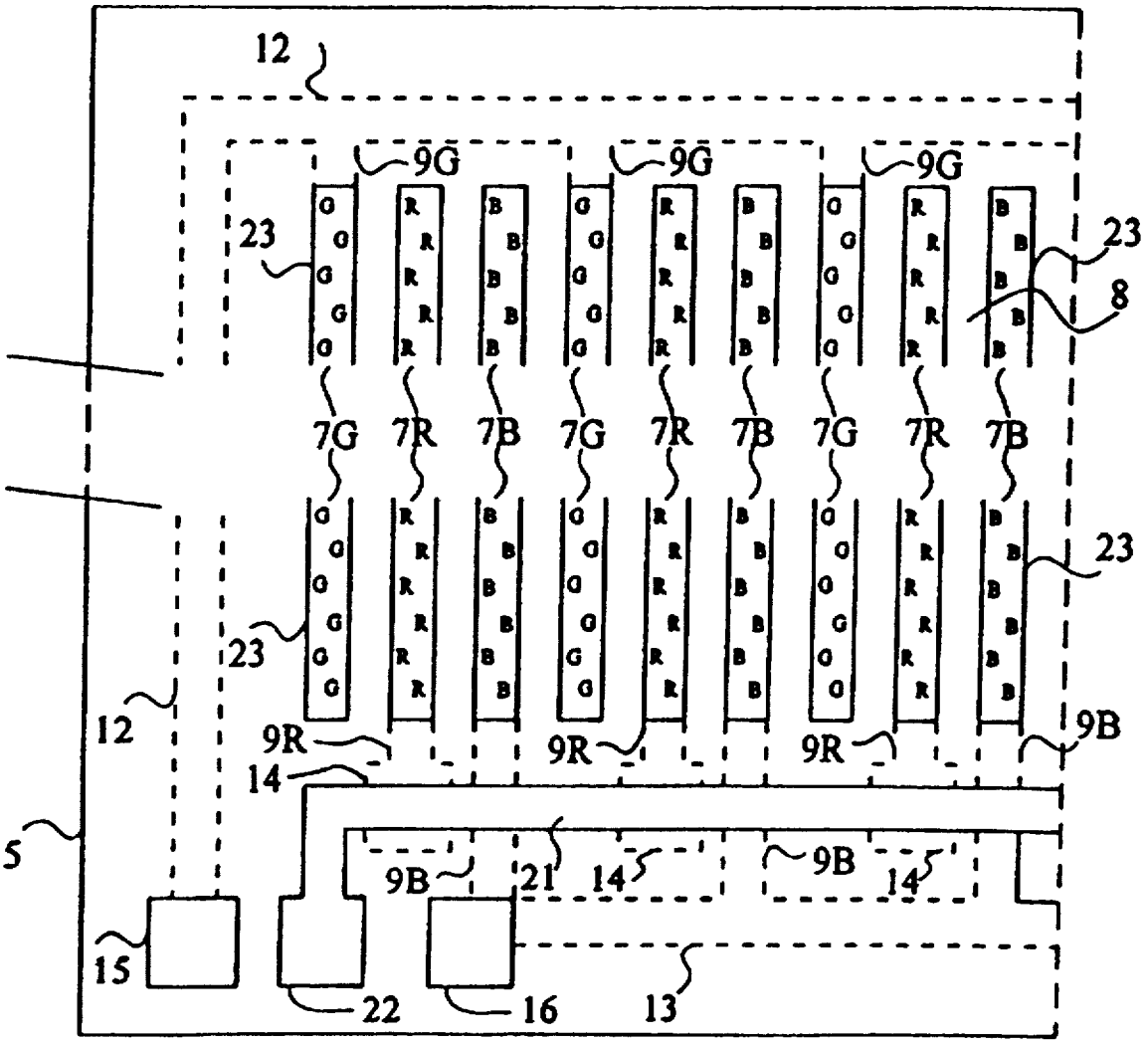
FIG. 3 is a top view of an anode according to the invention for a flat display screen.

FIG. 3 is a schematic top view of an anode 5 of a flat display screen according to the invention. As represented, inter-connection paths 12, 13 and 21 and connection pads 15, 16 and 22 are respectively provided for each of the three series of anode conductors *9g*, *9b* and *9r*, respectively associated with a color (green, blue, red) of phosphor elements *7g*, *7b* and *7r*, respectively. The interconnection paths are achieved at two different levels. The first two paths 12 and 13 are directly formed over or by the material which constitutes the anode conductive layer 9. A third path 21 is formed after interposition of an insulating layer 8. The phosphor elements *7g*, *7b* and *7r* are deposited in holes 23 formed in the insulating layer 8, in register with the anode conductors *9g*, *9b* and *9r*, in the useful area of the screen. Pads 15, 16 and 22 allow both to activate the desired series of anode conductors *9g*, *9b* and *9r* during deposition of phosphor elements 7, and to significantly simplify the connections of anode 5 to the control system. A single pad for each color is now sufficient to bias the anode 5, during the operation of the screen.

Figure 4:
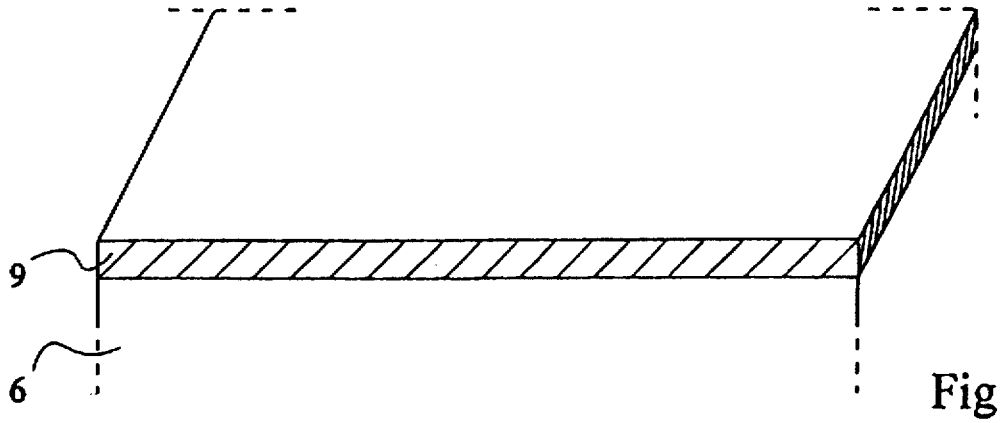

FIGS. 4–6 represents an exemplary implementation of a first phase of the method according to the invention. More particularly, this first phase consists of fabricating anode conductors 9 to receive phosphor elements and first two interconnection paths of the first two series of anode conductors *9g* and *9b*.

During a first step (see perspective view of FIG. 4), a transparent conductive layer, for example made of indium and tin oxide (ITO), is deposited on a glass substrate 6 to constitute anode conductors 9.

Figure 5A:
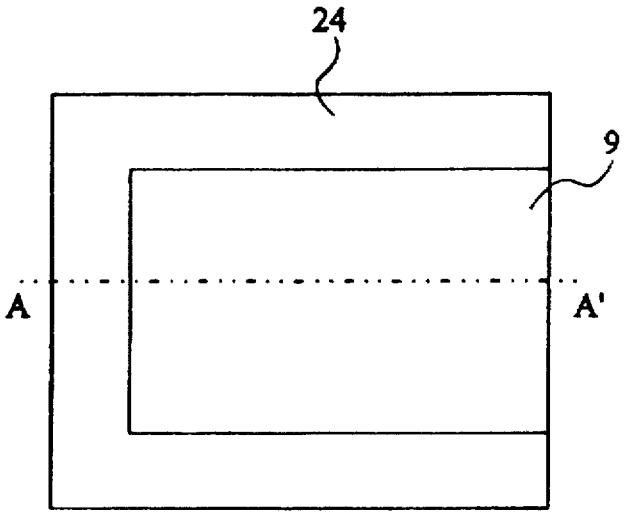
Figure 5B:
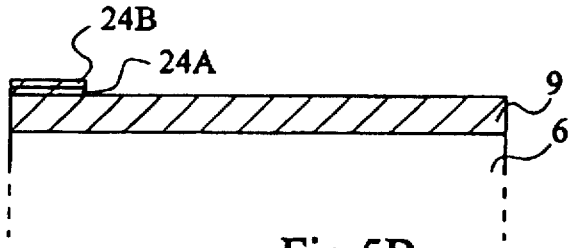

FIG. 5B is a cross-sectional view along the dotted line A–A' of the front view of FIG. 5A. A second step (FIGS. 5A and 5B) consists of depositing a conductive layer 24. The conductive layer 24 is preferably constituted by a thin anchoring layer 24A over which is deposited a metal layer 24B. The layer 24 is deposited at least over two edges of the surface of the ITO layer. In practice, this deposition is achieved over three edges so that the three interconnection paths which are subsequently formed are on the same side of anode 5. The width of layer 24 is such that it does not cover the useful surface of anode 5. This enables to significantly reduce the amount of materials constituting the layer 24.

FIGS. 6B, 6C and 6D are cross-sectional views along lines B–B', C–C' and D–D', respectively, indicated in dotted lines in the front view 6A. During a third step (see FIGS. 6A–6D), layers 24 and 9 are etched so as to simultaneously form three series of alternated strips *9g*, *9r* and *9b* of anode conductors, two interconnection paths 12 and 13 of first two series *9g* and *9b*, and pads 14 for each of the strips of the third series *9r*. A connection pad, 15 and 16, respectively, is also formed on each interconnection path 12 and 13. In FIG. 6A, the dotted line 24 indicates the lower limit of layer 24 deposited during the preceding step. The anode conductor strips *9g* and *9b* are respectively prolonged at one of their ends outside the useful surface of the screen, to be connected to the interconnection path 12 or 13. Pads 14, 15 and 16 are preferably grouped on the same side of anode 5.

At the end of this first step, ITO anode conductors 9, two interconnection paths 12 and 13, and pads 14, 15 and 16 made of metal or of other highly conductive material, are formed.

According to a simplified alternative of the present invention, during this first step, the metallic layer 24 is not deposited. Then, the structure of the anode conductor strips *9r*, *9b* and *9g*, of interconnection paths 12, 13 and of pads 14, 15, 16 is directly formed in the transparent conductive layer 9.

Figure 7A:
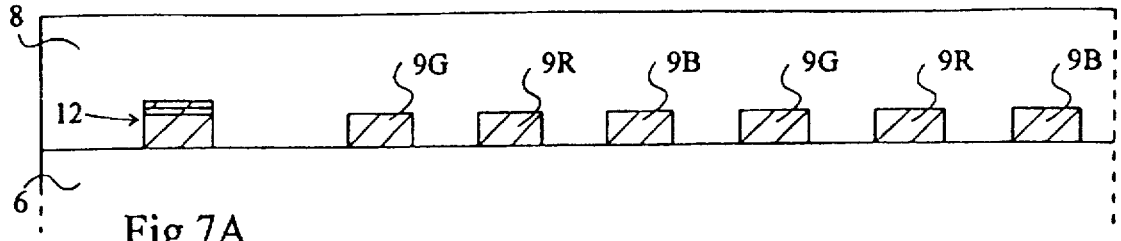
FIGS. 7A–7E schematically illustrate an embodiment of a second step of the method according to the invention for fabricating the anode of a flat display screen.
Figure 7B:
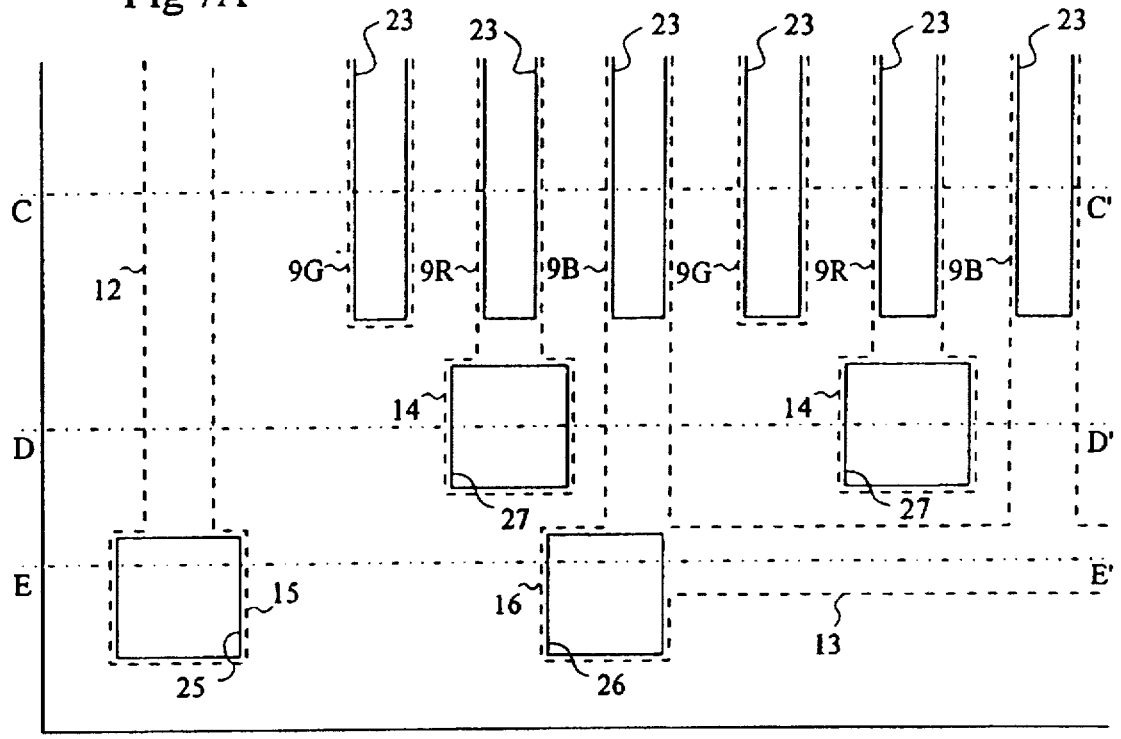
Figure 7C:
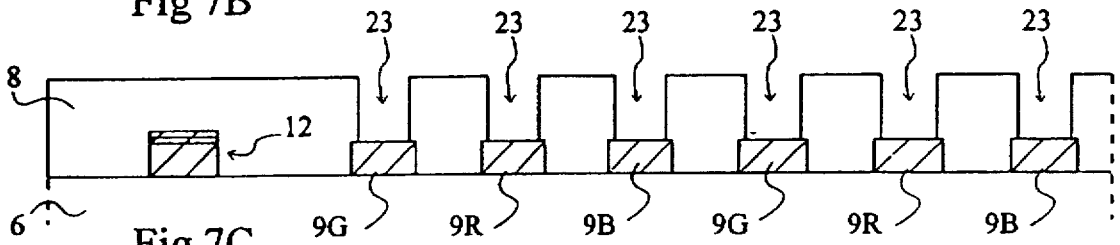
Figure 7D:
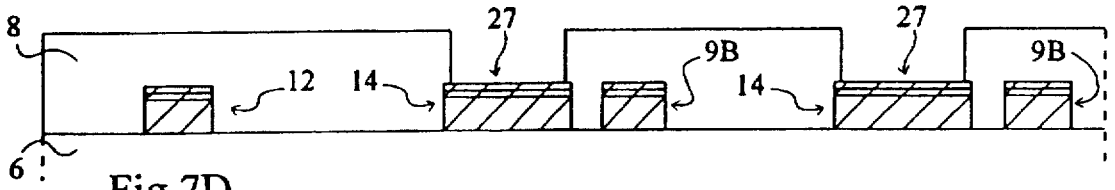
Figure 7E:
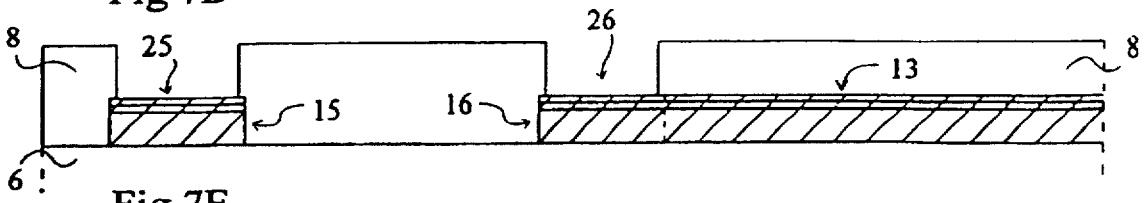

FIGS. 7A–7E illustrate the successive steps of a second phase of the method according to the invention. FIG. 7A is a cross-sectional view along line C–C' drawn in dotted lines in FIGS. 6A and 7B. FIG. 7B is a top-view of a portion of FIG. 6A. FIGS. 7C, 7D and 7E are cross-sectional views along lines C–C', D–D', and E–E' drawn in dotted lines in FIG. 7B.

During a first step (FIG. 7A) a layer 8 made of an insulating material is deposited on the pile formed during the first phase.

The insulating layer 8 is then etched, during a second step, to form holes 23 facing the anode conductors 9 in the useful surface of anode 5. This etching also forms windows 25 and 26 facing connection pads 15 and 16 and at a position 27 facing pads 14.

Figure 8A:
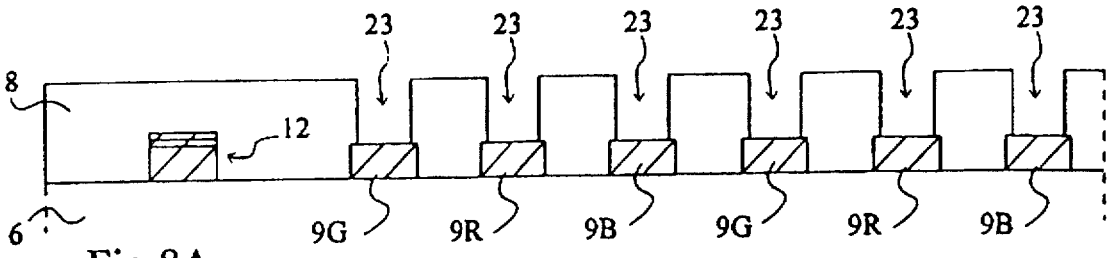
FIGS. 8A–8F schematically illustrate an embodiment of a third step of the method according to the invention for fabricating the anode of a flat display screen.
Figure 8B:
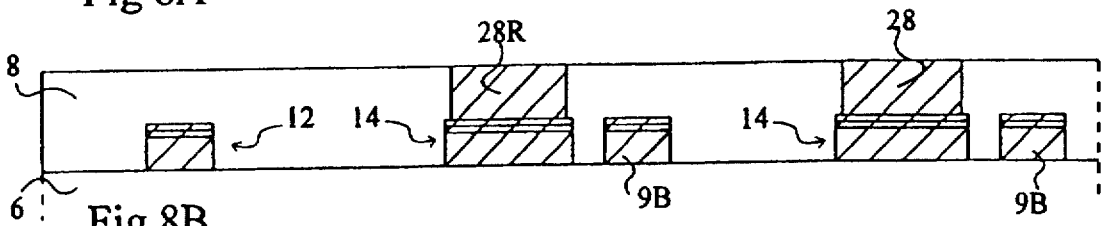
Figure 8C:
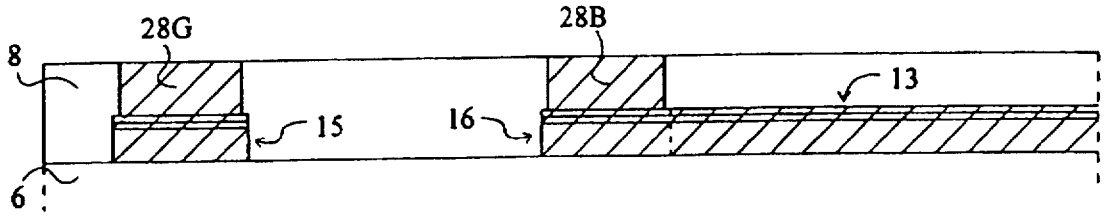
Figure 8D:
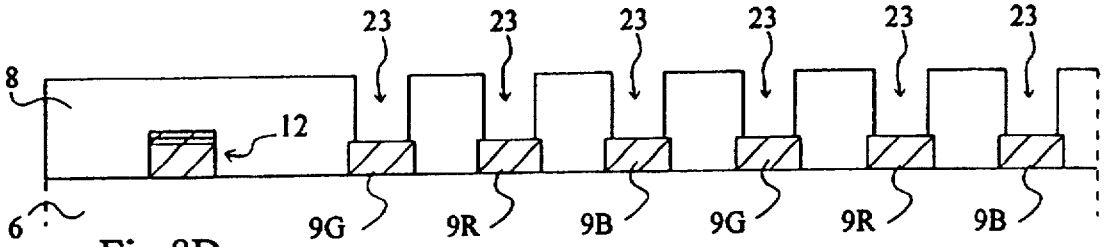
Figure 8E:
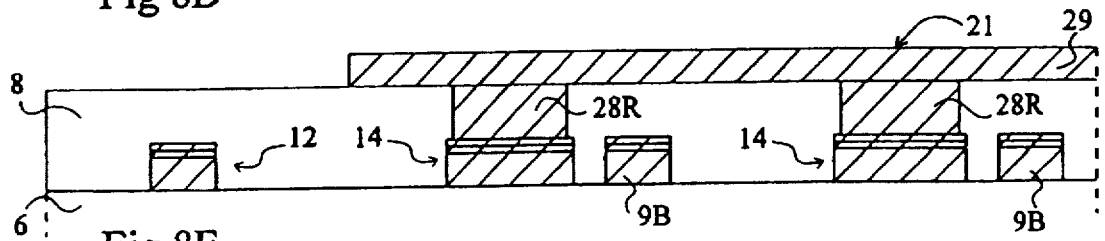
Figure 8F:
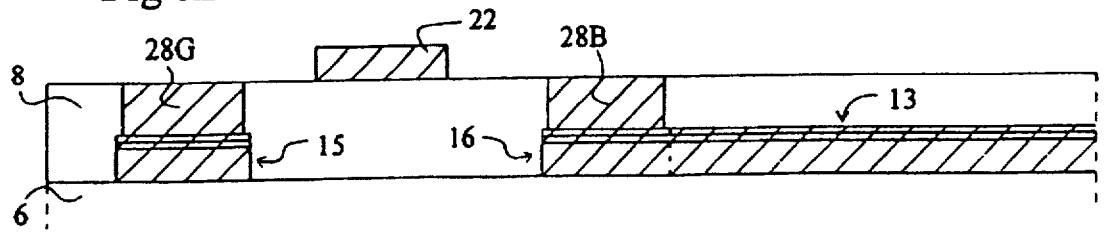

FIGS. 8A–8F illustrate two steps of a third phase of the method according to the invention. They are cross-sectional views along lines C–C', D–D' and E–E' of FIG. 7B. FIGS. 8A and 8D are cross-sectional views along lines C–C', FIGS. 8B and 8E are cross-sectional views along lines D–D', and FIGS. 8C and 8F are cross-sectional views along lines E–E'.

During a first step (FIGS. 8A–8C), a filling 28 of all the windows 25, 26 and 27 which have been etched in register with pads 15, 16 (FIG. 8C) and 14 (see FIG. 8B) is carried out from the pile provided in the second phase. This steps consists of an electroless deposition of a layer from a bath containing a salt of the metal to be deposited. Such a deposition is advantageous in that it is selective, and deposits only over the conductive surfaces of windows 25, 26 and 27 without filling holes 23 whose surface is constituted by ITO (FIG. 8A). In the implementation of the invention, such a deposition enables a significant sparing of the material, for example gold, constituting fillings 28.

A second step (FIGS. 8D–8F) consists of achieving an interconnection path 21 ended by a connection pad 22 (FIG. 8F) of the anode conductors 9*r* of the third strip series. For this purpose, the apparent surfaces of fillings 28*r* facing pads 14, are interconnected. This second step can, for example, be achieved with a uniform deposition of a conductive material 29 which is then etched to form path 21 and the connection pad 22. The material 29 must be selectively etchable with respect to the filling material 28.

Thus, for each of the three series of anode conductors 9*g*, 9*b* and 9*r*, an interconnection path 12, 13 and 21 is obtained, which, with fillings 28*g*, 28*b* and 28*r*, and pads 15, 16 and 14 enables single connection without step crossing for biasing the anode conductors associated with a same color.

According to a simplified alternative of the present invention in which, during the first phase, the patterns of strips, paths and pads have been directly formed in the transparent conductive layer 9, the first filling step of the third phase is omitted. Then, the interconnection path 21 and its pad 22 is directly formed. This can, for example, be achieved by serigraphy, the serigraphy material penetrating in holes 27 contacting pads 14.

Figure 9A:
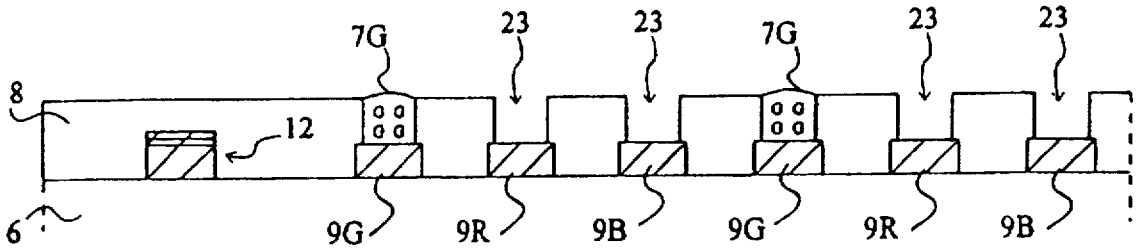
FIGS. 9A–9C schematically illustrate an embodiment of a fourth and last step of the method according to the invention for fabricating the anode of a flat display screen.
Figure 9B:
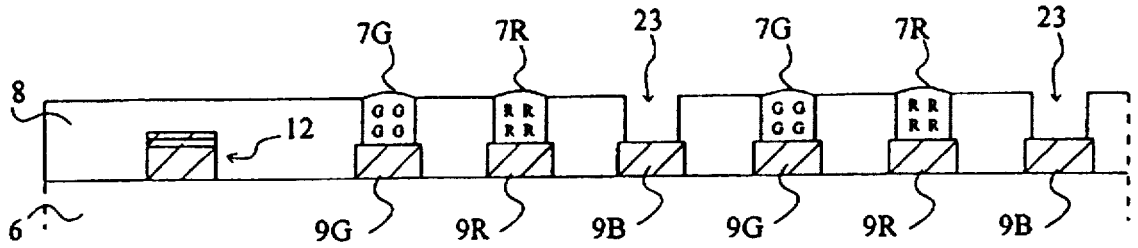
Figure 9C:
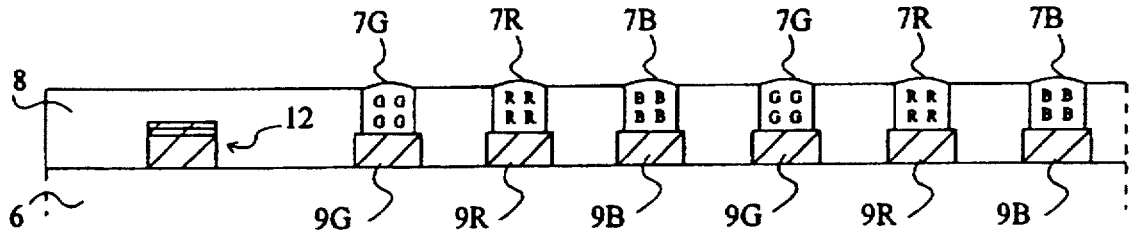

FIGS. 9A–9C illustrate a fourth and last phase of the method according to the invention, which corresponds to a deposition phase of phosphor elements 7. This phase includes the same steps of the conventional methods for depositing phosphor elements. This deposition of phosphor elements is achieved in three successive cataphoretic steps. Each step corresponds to the deposition of a color of phosphor element, by suitably driving a series of anode conductors 9. Thus, for example, during a first step (FIG. 9A) green phosphor elements 7*g* are first deposited in holes 23 over the anode conductors 9*g*, by exciting them through filling 28*g* (if any), the connection pad 15 and the interconnection path 12. Then, during a second step (FIG. 9B), this operation is repeated with blue phosphor elements 7*b*, by exciting the anode conductors 9*b* through filling 28*b*, the connection pad 16 and the interconnection path 13. Lastly, during a third step (FIG. 9C) the red phosphor elements 7*r* are deposited by exciting the anode conductors 9*r* through the connection pad 22, the interconnection path 21, fillings 28r and pads 14.

An anode 5 as represented in FIG. 3 is then obtained.

The method described above enables to create interconnection paths of strips of phosphor elements for each color, used both to deposit phosphor elements, and to bias anode 5 when the screen is used. Thereby, the use of a pin connector is avoided, and the connections between the anode and the control system are simplified. In addition, the method according to the invention particularly decreases the consumption of expensive deposition materials.

A specific implementation of an anode according to the invention will now be described, indicating for each step, the materials that are used and the operation mode. For some steps, alternatives based on the use of another material will be indicated Phase 1:

Step 1: depositing over the whole substrate 6 a transparent conductive layer 9, for example made of indium and tin oxide.

Step 2: depositing, for example by serigraphy, a layer of gold (alternative 1) or of nickel (alternative 2), 24B with interposition of a thin anchoring layer 24A, for example made of chromium, over three sides of the periphery of the plate.

Step 3: etching anode conductors 9 arranged in three series of strips 9*g*, 9*b*, 9*r*, interconnection paths 12 and 13 and connection pads 15 and 16 of first two series, as well as pads 14 of the third series. This etching is, for example, a photolithographic etching.

Phase 2:

Step 1: depositing over the whole plate an insulating layer 8. It can be, for example, a chemical vapor deposition (CVD) at normal pressure of silicon oxide ($SiO_2$).

Step 2: etching the insulating layer 8 to form holes 23 to receive phosphor elements facing the anode conductors 9, and windows 25, 26 and 27 facing pads 15, 16 and 14. This etching is, for example, achieved in a thrifluoromethane plasma ($CHF_3$).

Phase 3:

Step 1: electroless deposition of gold (alternative 1) or of copper (alternative 2) to fill windows 25, 26 and 27 with a conductive material.

Alternative 1: this deposition is, for example, achieved in a bath containing sulfites (sodium sulfite ($Na_2SO_3$), or gold-sodium disulfite($Na_3Au(So_3)_2$)) or cyanide ($KAuCN_2$) as a metallic ion source, containing formaldehyde (HCHO), hypo-phosphite or other as a reductive agent, and containing ethylen-diaminetetracid (ETDA) as a complexing agent of metal ions.

Alternative 2: the deposition is, for example, achieved in an alkaline solution containing copper salts (copper sulfates and chlorides) as a metal ion source to be deposited, containing formaldehyde (HCHO) as a reducing agent, and ethylen-diaminetetracid (ETDA) or tartates as a complexing agent of metal ions.

In both alternatives, a pH regulator (NaOH or other) is preferably added with other additives liable to increase the performances (speed, and so on) of the deposition and the bath stability. These additives can be, for example, sodium cyanide (NaCN) in the case of a copper deposition bath, or potassium bromide (KBr), or 1–2 diaminoethan, or ammonium chloride ($NH_4Cl$), sodium citrate or others in the case of a gold deposition bath.

Step 2: depositing over the whole plate an organometallic precursor layer 29. Then, localized irradiation of layer 29 by laser writing, in accordance with the pattern of the interconnection path 21 of the apparent surfaces of fillings 28*r* formed in windows 27. Then removing layer 29 at places where the layer was not irradiated by the laser beam, by dissolution with a suitable solvent. The thickness of the obtained removed portion is determined by the size of the beam, the laser beam power (for example approximately 1 watt), the type of support of layer 29, and the scan speed.

Alternative 1: the organometallic precursor 29 used is a powder of palladium acetate ($Pd(CH_3COO)_2$) solved in chloroform ($HCCl_3$);

Alternative 2: the organometallic precursor 29 used is copper formiate ($Cu(HCOO)_2$).

These precursors can be decomposed at temperatures ranging from 300°to 500° C., which is adapted to the use, for example, of an eximer laser or an argon laser whose radiation is within the range of ultraviolet or visible radiations.

This second step can be replaced with a simple serigraphy step.

Phase 4:

Step 1: cataphoretic deposition, with excitation of the anode conductors 9*g* of the first series, of green phosphor elements 7*g*.

Step 2: cataphoretic deposition with excitation of the anode conductors 9b of the second series, of blue phosphor elements 7b.

Step 3: cataphoretic deposition with excitation of the anode conductors 9r of the third series, of red phosphor elements 7r.

According to an alternative of the method according to the invention, a step of electroless deposition, for example of gold or copper, can be achieved between phases 1 and 2 to reinforce, if required, the thickness of the interconnection paths 12 and 13, before deposition of the insulating layer 8.

According to another alternative embodiment of the method according to the invention, the step 2 of phase 2, i.e., the peripheral deposition of layer 24, is achieved by laser etching of an organometallic precursor, such as, for example, palladium acetate.

As is apparent to those skilled in the art, various modifications can be made to the above disclosed preferred embodiments. More particularly, each described material of the layers constituting the anode can be replaced with one or more constituting elements providing the same function. Also, each deposition or etching step can be replaced with an equivalent step providing the same function.

I claim:

1. A fabrication method of an anode (5) of a flat display screen, including the following phases:

1) forming, on a substrate (6), three series of anode conductors (9) in alternated parallel strips (9g, 9b, 9r), two first interconnection paths (12, 13) of the first two series of anode conductors (9g, 9b), first two connection pads (15,16) to the first two paths, and pads (14) of a third series of anode conductors (9r);

2) depositing an insulating layer (8) over said substrate (6), conductors (9), paths (12, 13) and pads (15, 16, 14), and etching, in said insulating layer (8), holes (23) to receive phosphor elements (7) in register with the anode conductors (9), and windows (25, 26, 27) in register with the pads (15, 16, 14);

3) forming a third interconnection path (21) of the third series of anode conductors (9r) and a third connection pad (22) over said insulating layer;

4) electrically coupling said third connection pad (22) to said pads (14) of said third series of anode conductors (9r); and, 5) depositing phosphors (7) over the anode conductors (9) in the holes (23) of the insulating layer (8).

2. The method of claim 1, wherein the first phase includes the filling of the windows (25, 26, 27) with a conductive material.

3. The method of claim 1, wherein the third interconnection path (21) and the third connection pad (22) are achieved by depositing over the insulating layer (8) an organometallic precursor (29), irradiating the latter by laser, and removing non-irradiating precursor by a suitable solvent.

4. The method of claim 1, wherein the fourth phase for depositing phosphors (7g, 7b, 7r) is achieved by a cataphoretic deposition in three steps, by successively exciting the anode conductive strips (9g, 9b, 9r) of the three colors through electrically connecting pads (15, 16, 22) to which the strips (9g, 9b, 9r) are respectively connected.

5. The method of claim 1, wherein the first phase includes the following steps:

depositing anode conductors (9) on a glass substrate (6); and etching according to a row pattern, to form the three series of strips of anode conductors (9g, 9b, 9r) in the anode conductor layer (9), and the first two interconnection paths (12, 13) as well as the pads (15, 16, 14).

6. The method of claim 5, further including the step of depositing a conductive layer over at least two sides of the periphery of the plate.

7. The method of claim 1, wherein the third phase further includes the step of depositing a conductive filling material (28g, 28b, 28r) in the windows (25, 26, 27).

8. The method of claim 7, wherein the filling (28) of the windows (25, 26, 27) is achieved by electroless deposition.

* * * * *